United States Patent [19]

Walter

[11] 4,194,581

[45] Mar. 25, 1980

[54] DEEP DRILL HAMMER

[76] Inventor: Hans P. Walter, Neissestrasse 1, D-3570 Stadt Allendorf 1/BRD, Fed. Rep. of Germany

[21] Appl. No.: 845,099

[22] Filed: Oct. 25, 1977

Related U.S. Application Data

[63] Continuation of Ser. No. 669,120, Mar. 22, 1976, abandoned.

[30] Foreign Application Priority Data

Mar. 22, 1975 [DE] Fed. Rep. of Germany ..... 2512785

[51] Int. Cl.[2] ..... E21B 5/00

[52] U.S. Cl. ..... 175/92; 173/64; 173/73; 173/78; 173/80

[58] Field of Search ..... 64/23; 173/15, 16, 73, 173/78, 64–66, 8 D, 159, 131; 175/325, 321, 296, 92, 410, 413, 419, 414

[56] References Cited

U.S. PATENT DOCUMENTS

| | | | |
|---|---|---|---|
| 2,810,549 | 10/1957 | Morrison | 173/139 X |
| 3,680,412 | 8/1972 | Mayer | 173/164 |
| 3,791,463 | 2/1974 | Pearson | 173/80 |
| 3,952,819 | 4/1976 | Adcock | 175/293 |
| 3,970,153 | 7/1976 | Glen | 173/66 |

OTHER PUBLICATIONS

Stoffel Polygon Systems, Sales Brochure 11-1971.

*Primary Examiner*—William F. Pate, III
*Attorney, Agent, or Firm*—Fred Philpitt

[57] ABSTRACT

A down hole percussion drill having an inner tube located within an outer tube guiding a ram for reciprocating movement relative to a drill steel. The drill steel and/or a wear bit secured thereto as well as retainers for them are provided with matching disharmonic polygonal profiles for sliding fit under load, free of edge pressure and with full power transmission by the lateral faces. The outer tube top end and a piston therein may have like polygonal connection. The inner tube is rigidly attached in the center of the outer tube by a unitary supporting head into which a coaxial control cylinder projects that has a valve seat for a mushroom valve with peripheral notches at its outer edge and further has an inner control tube with a slidable spring-loaded control sleeve for governing pneumatic fluid through suitable flow links. The control unit is of simple design and regulates intake and/or scavenging fluid as well as the high pressure impact and return strokes of the ram which hits the drill steel below the lower end of the inner tube. Hollow spaces and/or radial holes for starting up ventilation are provided in the ram, in the inner tube and/or in the outer tube each section of which may be fluted outside. Damping spaces are and cushioning elements may be inserted between movable parts.

9 Claims, 14 Drawing Figures

Figure 1A:
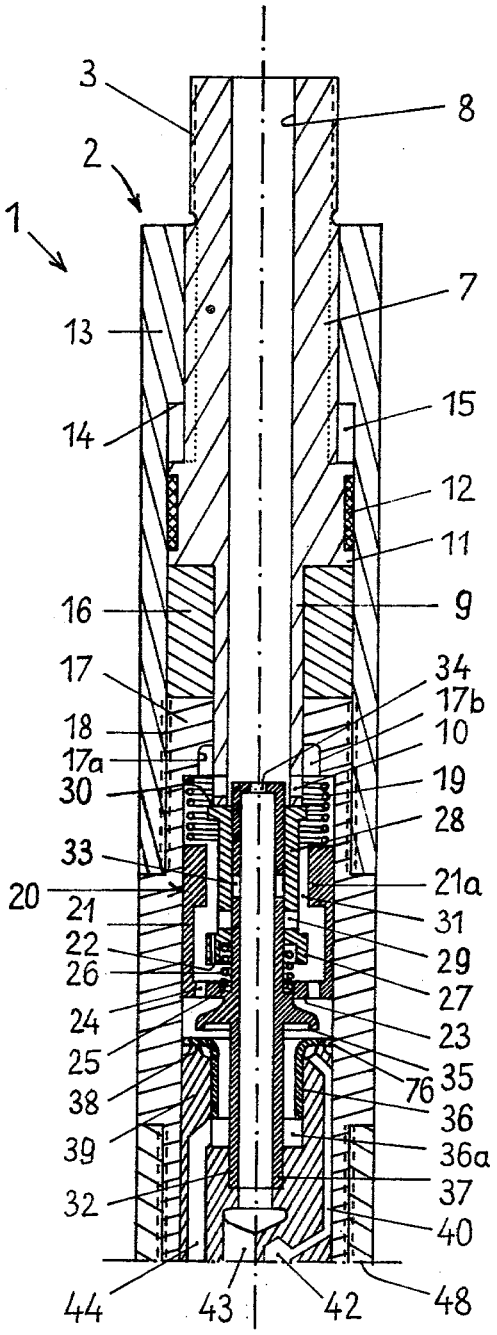

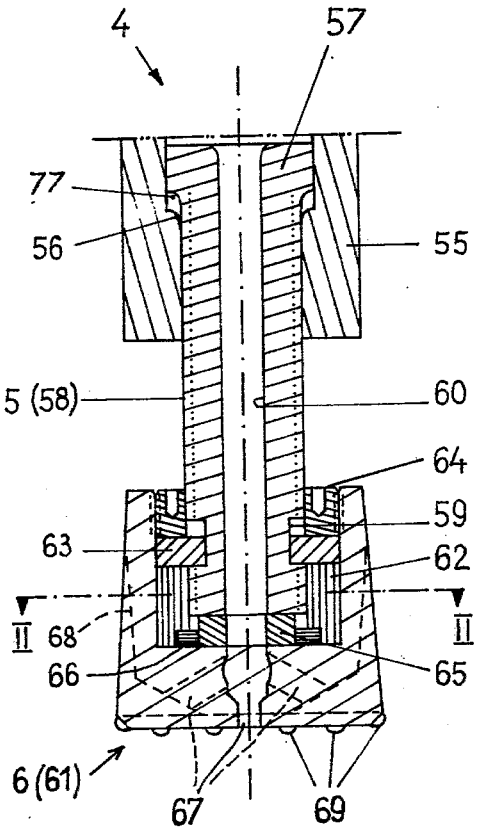
FIG. 1c
FIG. 4
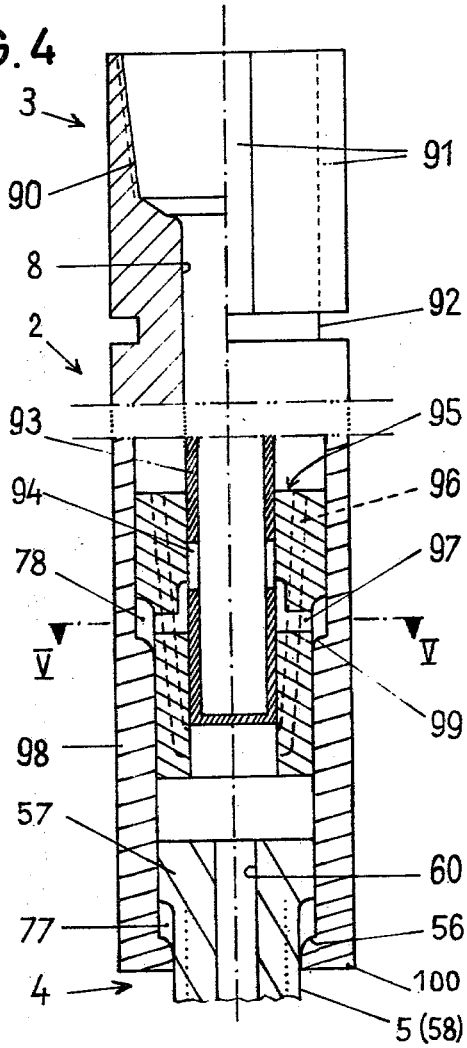
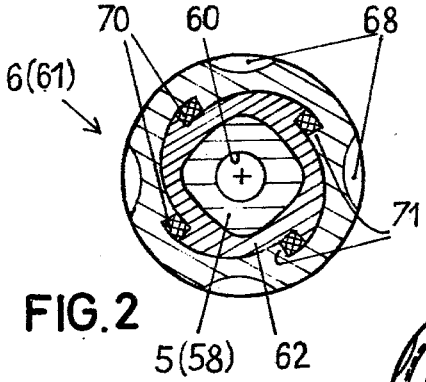
FIG. 2
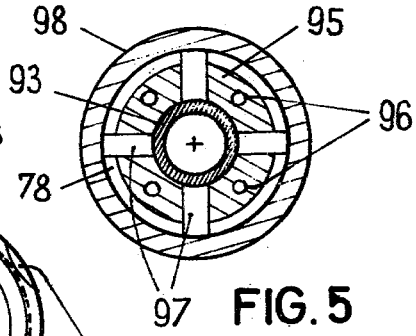
FIG. 5
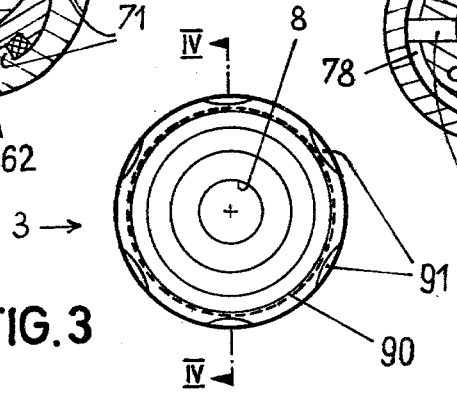
FIG. 3

DEEP DRILL HAMMER

This is a continuation of application Ser. No. 669,120, filed Mar. 22, 1976, now abandoned.

Such deep drill hammers are known from, for example, DT-PS 1 000 310. Here, the means of compression is connected permanently, and uncontrolled, with the ram. Exhausting of the compressing agent takes place at the end of the return stroke and at the commencement of the striking stroke, which proceeds from the weight of the ram itself and from the pressure of the compressing agent fed in, which expands in an annular space between the ram and the outer tube, thereby effecting the return sroke. The dimensions of this annular space are critical for the made of operation of the hammer, which in addition is itself decisively influenced by the diameter of the rod of the ram, which guides the ram with a large amount of radial play. As a result, the useful area of the ram is greatly reduced. In addition, the ram itself is heavy and long, so that its mass moment of inertia militates against a rapid striking cycle. Steady extraction of the drillings produced remains an unsolved problem. Furthermore, not only the reliable control of operation of the drill hammer, but also its economy, leave much to be desired.

Other deep drill hammers are described in, for example U.S. Pat. Nos. 2,837,317, 2,887,989 and 3,568,783, and also in DT-PS Nos. 1 186 816, 1 238 864 and 1 408 666. In the case of these designs, which vary considerably one from another, the ram always runs inside its own cylinder, which calls for special accuracy in manufacture and in addition complicates the supply of the compressing agent, which has to be fed into the working space through channels which, to some extent, are very narrow and twisted. In consequence, the layout of such drill hamers is complex, and their operation is correspondingly liable to breakdowns.

An important aim of the invention is to overcome these and other disadvantages of the present state of the technology by simple means and to produce deep drill hammers which, while of straightforward design and economy in manufacture, permit reliable, cost-cutting high-performance operation, even in unfavourable working conditions. In particular, reliable functioning in a wide variety of types of rock should be ensured to the same extent as insensitivity to fouling, as well as simplicity of handling and maintenance.

In the case of a deep drill hammer of the type referred to at the outset, the invention envisages that at least those parts of the hammer which transmit the power and are axially moveable are formed with a polygonal profile. By so doing, it is ensured, at a small outlay and in a surprisingly simple manner, that the moving parts—in any case, to the extent that they serve the purpose of drive or of the transmission of power or torque—are not only freely displaceable axially, but also follow every rotating movement faithfully. The positive sliding movement and efficient sealing thereby achieved plays a major part in ensuring low-loss pneumatic drive. At the same time, there is particularly favourable utilisation of the available cross-sections which, in comparison with conventional deep drill hammers, are greatly enlarged, with the result that, in practical use, increases of over 40% in performance can be obtained.

It is true that, in the present state of the technology, non-cylindrical profiles have already been used for deep drill hammers, e.g., in accordance with the abovequoted DT-PS No. 1 186 816. Longitudinal grooves in the shaft of the ram and of the drill steel interrupt the cylindrical cross-section at the circumference, with the result that the latter acquires a wedge-shaped profile, as is usual with shaft and collar joints. There is, however, no power or torque transmission via the profile of these parts of the drill hammer. Furthermore, these shapes are not true polygonal or K profiles, which always consist of multi-corner profiles without any notch effect for the form-locking joining of an outer part to an inner part.

One important version of the invention provides that the inside tube located centrally and in a form-locking manner in the ram be preferably of a disharmonic PC4 profile. Thus, the ram itself, in particular, slides on a polygonal inside tube which permits, not only upward and downward movement, but also the transmission of torques. The designation PC4 specified in the relevant Standard indicates a polygonal shaft section similar to a square, the edges being rounded at the curvature of the outer radius and the polygonal areas lying between them being curved in the manner of a flat cycloid.

It is advisable for the inside tube to have air openings which, depending on the position of the ram, are closed or opened by it, thereby greatly simplifying control of the drill hammer. In particular, the air openings can be in the form of two axially parallel holes in the inside tube, with lateral openings, of which at least one is assigned to a corresponding recess in the ram. It is advantageous if these holes are located near to opposite edges of the polygon or on a main diameter of the inside tube.

In a development of the invention, the ram has axial and radial passages separated from one another, by means of which, depending on the position of the ram, flow links can be set up to corresponding recesses in the inner and outer tube of the hammer. This design enables a wide variety of desired applications to be accommodated with only a few basic types.

For the achievement of high performances coupled with operationally reliable control, the invention also envisages that the inside tube is in flow relationship with the drive sections of the hammer or can be brought into direct flow connection, especially, on the one hand, via passages, with a damping piston fitted to the upper end, and on the other hand, with the drill steel.

A further increase in performance can, in accordance with the invention, be achieved by arranging for the shaft of the drill steel, in the form of the bore crown, to carry, in such a way that it is capable of sliding movement, a wear bit which is, at least in an axial direction, flexibly cushioned. By this means, tool and rod are conserved, because the cushioning absorbs or prevents the shocks which occur without any significant consumption of striking energy. There is also a considerable reduction in costs, because, when the tool has become blunt, it is initially necessary to replace only the cushioned wear bit, whereas the shaft of the drill steel, which serves as an intermediate anvil, does not, thanks to its much longer service life, need to be replaced until much later.

The useful life can be further prolonged if the wear bit has at least one polygonal insert, the outer part of which is recessed on its circumference and, by means of resilient packing, is cushioned in a peripheral direction. In this way, a bore crown with a long cutting life is obtained, which enables tthe drill hammer to advance rapidly and powerfully, especially in medium-hard rock, but also permits notable drilling speeds to be achieved in hard rock.

For the supply of the pressure agent, which, preferably, is compressed air, a further development of the invention provides for the damping piston to have a central passage and, at its bottom end, radial outlets. The damping piston can also be cushioned by a ring buffer which bears axially on a tube-shaped cage screwed into the outer wall of the hammer and containing a slide insert for ease of movement.

Manipulation of a drill hammer in accordance with the invention is made considerably easier if the part of the hammer connected to the rod has a cone thread with peripheral notches, which fit in a form-locking manmer into a mating profile at the outer ends of the hollow rods. Such gripping profiles can be applied to gripping and breaking devices which may, either as an alternative or additionally, possess cheeks or segments which engage in a peripheral groove in the cone thread, thereby holding and supporting the drill hammer.

In another further development of the invention, the inside tube is rigidly connected to a supporting head into which a coaxial control cylinder projects, this latter having a valve seat for a control element passing with a sliding movement inside the supporting head. In particular, the inside tube can, in accordance with the invention, be made in one piece with the supporting head. By preference, the supporting head should be firmly secured in a tube-shaped housing screwed to the outer wall in which the control cylinder moves. By interchanging the supporting head and/or the ram, it is possible, by very simple means, to achieve a variety of characteristics or data for the drill hammer.

The invention further provides for the supporting head to have a lateral intake ending beside the inside tube, the one hole of which is connected to the control tube, while the other hole in the supporting head has a branch passage running underneath the control body. An interchangeable nozzle can be fitted in the upper closure in the front face of the control tube. Alternatively or additionally, there can be an interchangeable or closable side nozzle on the outer part of the valve body, e.g., on the outer circumference of a supporting ring, which otherwise serves purpose of sealing, or of the control cylinder. These measures contribute to the simplification and improvement of control of the operation of the drill hammer. It is also possible, both quickly and cheaply, to adjust and alter the mode of operation and performance of the drill hammer as required, and in accordance with the nature of the rock being drilled and the available compressor, by changing or replacing individual components of the control system or the entire control assembly.

In accordance with an important development of the invention, the valve body is in the form of a disc sleeve and/or provided at its outer edge with peripheral notches which, when the valve body rests on an axial valve seat, permits an external flow link. If, for example, the valve body, at the end of the downward movement of the ram, is lifted by the momentary back-pressure of the pressurising agent and pressed against the valve seat located above it, then the direct supply of the pressurising agent is interrupted. At the same time, the restricted inward flow of the pressurising agent flows via a leakage path past the peripheral notches, as a result of which the ram is stressed from below and raised to it starting position. A fresh operating cycle can then commence.

In accordance with a further feature of the invention, the control cylinder has an inner control tube, with cross holes at the top, to which a spring-loaded control sleeve is fitted so that it can slide, and has, at the bottom, corresponding cross holes, and the front flange of which can rest against the damping piston. These control parts are of a very simple nature; they can be produced cheaply and are easy to fit and to maintain. If the damping piston is retracted, as may happen when the drill steel meets no great resistance and, under its own weight, advances more rapidly than the thrust set for the drilling equipment, then the spring-loading of the control sleeve causes it to lift until there is a flow connection between the appropriate cross holes. An increased supply of the pressurising agent then flow through the cross holes into the control tube, so that flushing can take place under full pressure. At the same time, the part load or idling striking operation of the drill hammer continues via the side nozzles.

Provision can be made, between the top of the ram and a shoulder of the outer wall in which it moves, for a damping chamber, and also between the top of the drill steel and a projection on the retainer in which it moves. It is an advantage, in this case, if a flexibly yielding packing is fitted in at least one padding space and/or between axially moveable power-transmitting components.

To increase the economy of both manufacture and operation, a further version provides that there should be hollow spaces for starting-up ventilation in the ram and in the outside tube surrounding it. By this means, a marked improvement in the operating characteristics is achieved in the simplest possible way, with the result that the drill hammer works reliably even in unfavourable conditions. The ventilation cavities in the ram and in the outer tube surrounding it bring about satisfactory high-performance drive of the ram even where, because of back-pressure from the bottom of the borehole, blocking of flushing ports or the existence of leaks, a condition of dynamic pressure arises which, in the absence of the measures taken, could hinder or prevent operation of the drill hammer.

A development of the invention provides that holes in the ram, running obliquely upwards or radially, end in a padding space between the head of the ram and the outer tube, that holes in the ram, running obliquely downwards or radially, end in an annular space in the outside tube when the ram is in its raised position and that ventilaton ducts run from the annular space through the wall of the outer tube as far as its threaded connection to the retainer for the head of the drill steel. These cavities can be easily made with standard equipment and ensure start-up and precise operation of the drill hammer, irrespective of the initial position of the ram. Because the cavities are continued downwards through the clearance of the drill steel and additional ducts, ventilation is assured in all operation phases.

The invention also provides for the skewed holes to be located at the axial ends of a cylindrical recess in the ram. Apart from ease of production, this arrangement has the advantage of low-resistance flow with precise passage at those points which the ram opens uup in the various stages of its movement.

In accordance with a further version of the invention, a further radial start-up hole is provided in the bottom part of one of the longitudinal holes in the inner tube, on the outside beneath a radial opening, with the result that the pressurising agent (the compressed air) flows through it as long as the ram is in a raised position. In the vicinity of its lower end position, the head of the ram closes this start-up hole, while the other radial opening allows the unobstructed through flow of the compressed air.

An important improvement to the drill hammer, combined with a simplification of its manufacture, achieved by the invention lies in the fact that the ram and the tubes in which it moves are of cylindrical shape, enabling the use of a costly polygonal section for these parts to be dispensed with, without adversely affecting the mode of operation. This results in a considerable reduction in the cost of the drill hammer.

It is conducive to reliable working if the through hole in the ram is provided, at least in its upper section, with peripheral flutes, thereby ensuring free movement and good sliding characteristics.

Assembly is very simple if, in accordance with another feature of the invention, the retainer is split radially and its two halves pinned together immediately after insertion of the head of the drill steel, the diameter of which is increased as compared with the shaft.

In the case of a deep drill hammer with a control unit consisting of a control cylinder, a control tube with valve seat, a control sleeve with supporting cylinder and a control body, it is envisaged, in accordance with the invention, that the control cylinder can be secured in a form-locking manner to the valve seat collar on to the upper part of the control tube, that there should be fairly long cross holes near its upper end and that the control sleeve has longitudinal flutes on the outside of its supporting ring. This refinement represents a significant simplification, achieved with economy, permitting not only considerable saving in manufacture, but also a further increase in performance and operating reliability. Among other things, it ceases to be necessary to provide a by-pass nozzle, and the chosen arrangement, with fairly long cross holes in the upper part of the control tube and with longitudinal flutes on the supporting ring of the control sleeve, makes for the smallest possible flow resistance in both directions of flow.

Another development of the invention, for which separate protection is claimed, involves the provision of flutes on the circumference of at least one element of the parts of the hammer of polygonal section which transmit the power. For example, the retainer for the drill steel head can have longitudinal grooves or flutes in its polygonal hole, which act as ventilation ducts and allow stressed compressed air to escape into the borehole, thus ensuring that drillings or other extraneous matter can with certainty be prevented from forming a blockage during operation.

The damping piston, at least, can be provided with peripheral sealing with a view to minimising pressure losses and supplying the drill steel with as much of the available driving force as possible.

A further important version of the invention, for which separate protection is also claimed, envisages, for a drill steel consisting of a shaft and a wear bit interchangeably fitted thereto, that, for the detachable securing of the wear bit to the shaft of the steel drill, the bottom end of the latter has a projection which is engaged by radially divided fastening ring, with a stop collar, which is screwed into the wear bit. In comparison with the versions previously described, this represents a marked simplification of the means of securing the wear bit. As a result, the design and manufacture of the bore crown require much less effort; fewer parts are necessary, and fixing and detachment of the wear bit to and from the shaft of the bore crown can be effected considerably more quickly.

In this particular case, it is an advantage if the thread for securing the fastening ring in the wear bit turns in the same direction as the hammer drive and possesses a symmetrical, rounded thread-pitch. This does away with the necessity to secure the fastening, because the hammer drive itself screws the fastening ring as far as it will go into the wear bit and repeats this screwing in process with each operating cycle. In addition, the form of thread makes it possible, using a standard type of uncoupling device, quickly to disconnect the joint, especially when replacement of the wear bit of the drill steel is required.

It is also advantageous if the bottom end of the shaft of the drill steel engages in a form-locking manner in the inner front face of the wear bit, either directly or with the interposition of a resilient pad, in such a way that the whole of the impact energy supplied is transmitted to a wide area, and the specific load on the end of the shaft of the drill steel and on the wear bit remains relatively small.

For assembling and dismantling the drill hammer in accordance with the invention, it is an advantage if it is provided on the outside with a fluted profile, preferably over its whole length, so that breaking and gripping devices, such as are available for the drill rod, can be used for rapid dismantling and assembly of the drill hammer. In addition, the fluted profile permits improved flushing of the drillings out of the borehold.

Figure 6A:
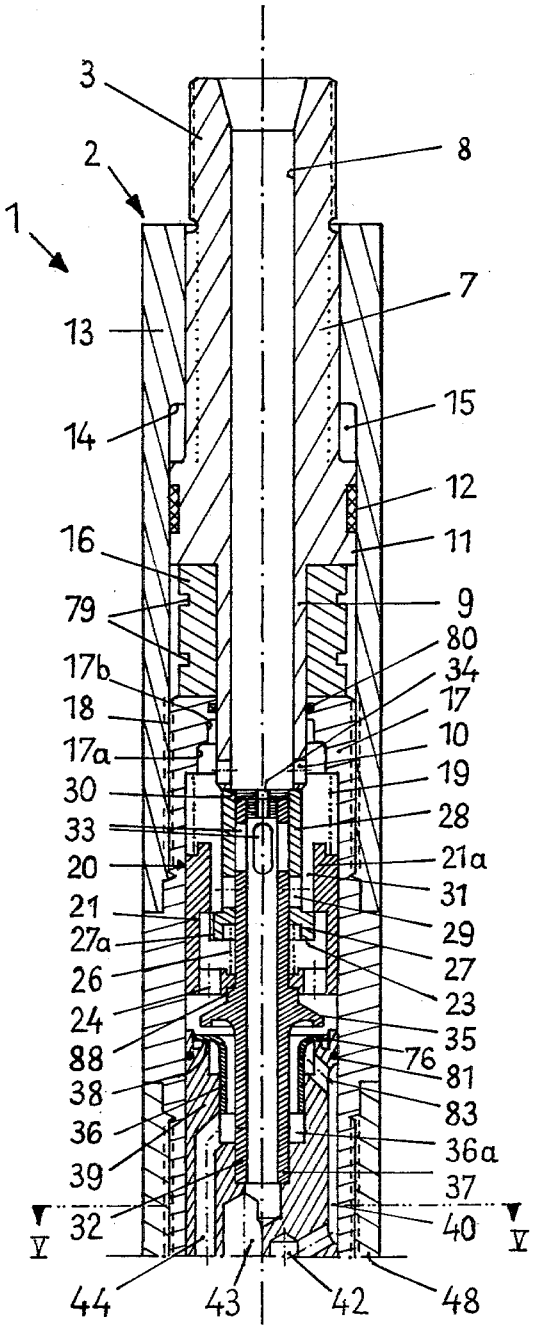
Figure 6B:
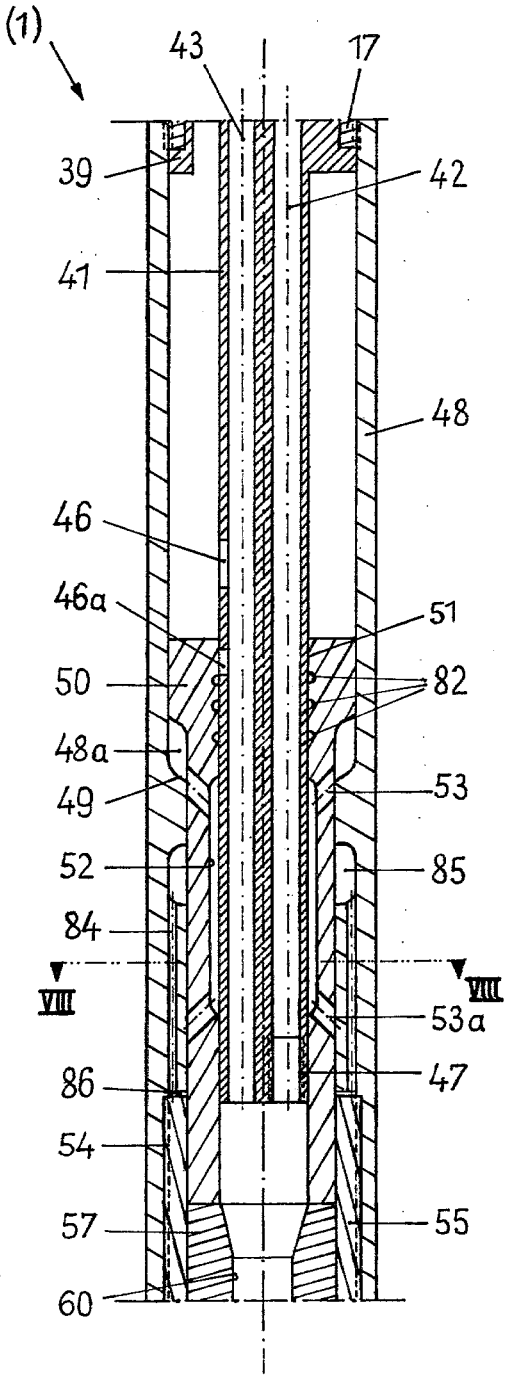
Figure 6C:
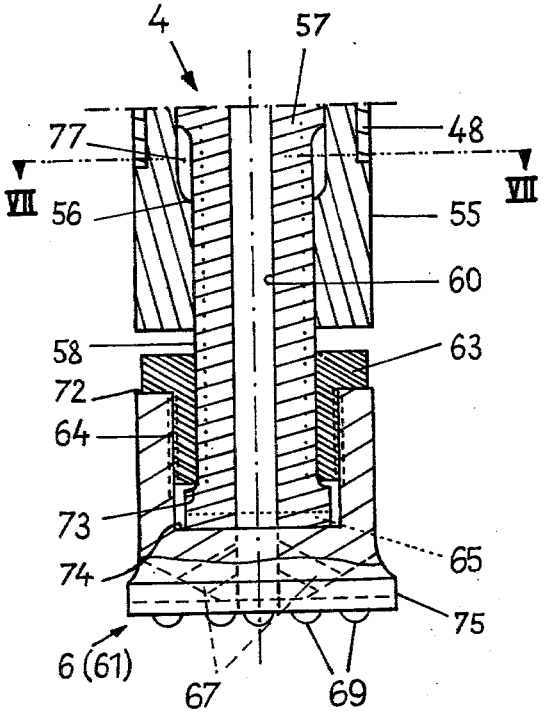
Figure 8:
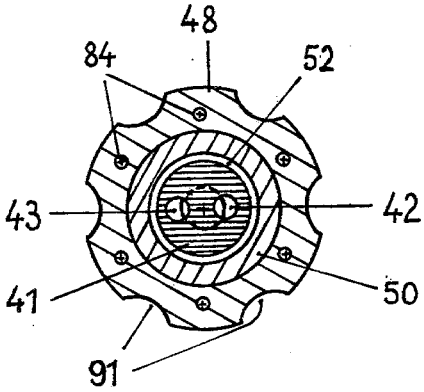
Figure 9:
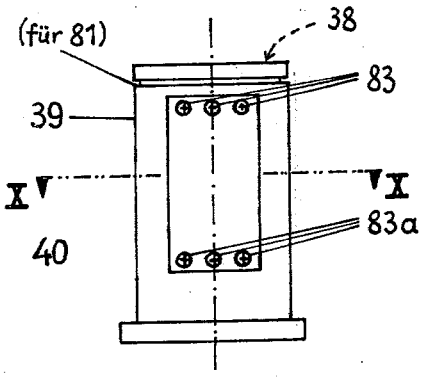
Figure 7:
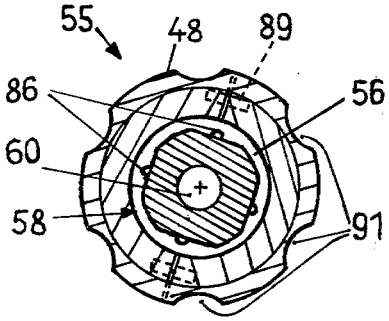
Figure 10:
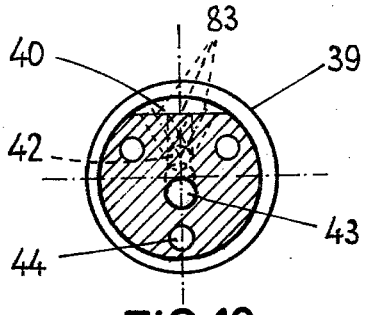

Additional features, details and advantages of the invention can be seen from the following description of examples of various versions, with the aid of the drawing, in which are shown:

FIG. 1*a, b, c:* parts, which can be regarded as adjoining, of an axial sectional view of a deep drill hammer in accordance with the invention, FIG. 2: a cross-section through the line II—II in FIG. 1*c*, FIG. 3: a view from above of the modified version of a drill hammer in accordance with the invention, shown in FIG. 4, FIG. 4: a sectional/side view, the upper part of which corresponds to the sectional line IV—IV in FIG. 3, FIG. 5: a cross-section through the line V—V in the lower part of FIG. 4, FIG. 6*a, b, c:* parts, which can be regarded as adjoining, of an axial sectional view of a deep drill hammer in accordance with the invention, FIG. 7: a sectional view through the line VII—VII in FIG. 6*c*, FIG. 8: a sectional view through the line VIII—VIII in FIG. 6*b*, FIG. 9: a side view of the upper part of the inside tube of the drill hammer in FIG. 6 and FIG. 10: a sectional view through the line X—X in FIG. 9 and V—V in FIG. 6*a*.

The hammer shown in FIG. 1 is indicated, in its entirety, by 1. Its upper part has a tube 2 with a threaded adapter as a fitting 3. Connected to the tube 2, at the bottom, is a drill steel 4, the shaft 5 of which carries a wear bit 6.

In the example shown in FIG. 1, the fitting 3 is in one piece with a damping piston 7 of polygonal section, which can slide in a form-locking manner in a damping cylinder 13 of the same cross-section. The damping piston 7 has a passage 8 and a tube extension 9, the bottom end of which has radial outlets 10. A sealing collar 11 supports a slide insert 12 in an axial direction, which can, for example, be made of tetrafluorpolyethylene and ensures ease of movement of the damping piston 7 in the damping cylinder 13. The stroke of the damping piston 7 is limited at the top by a shoulder 14 in a chamber 15. At the bottom, the stroke is limited by a ring buffer 16 which bears axially on a cage 17 which is secured by means of a threaded joint 18 to the damping cylinder 13 and has the same external diameter as the latter. Compared with the tube extension 9, the inside diameter of the cage 17 is offset, leaving room for a compression spring 19 which bears on the outer section 21 of a control cylinder 20.

In the upper, cylindrically re-entrant part 17*a* of the cage 17, there is a recess 17*b* which allows the passage of the pressurising agent from the radial outlets 10 in any position of the damping piston 7.

The outer section 21 of the control cylinder 20 has, at the top, a cylindrical projection 21*a*, contracting inwards, the inside diameter of which corresponds to the outside diameter of the supporting ring 27 of a control sleeve 28 fitted, so that it can slide, to the upper section of a control tube 32. The latter has, on its front face, a nozzle 34 and, as a fixed component of the control cylinder 20, is provided with cross holes 33 which, when the control sleeve 28 is in the raised position, can coincide with cross holes 29 in the latter.

At the bottom 23 of the control cylinder 20, there are holes 24 and a ring-shaped recess 25 containing a compression spring 26, the top end of which acts upon the supporting ring 27. As a result, the control sleeve 28 is held by its flange 30 against the bottom end of the tube extension 9, even when the damping piston 7 moves upwards from the end position shown in the drawing. The control sleeve 28, which then moves upwards with it, together with the supporting ring 27, enters a ring chamber 31 inside the inward-contracting cylindrical projection 21*a*; in this position (not shown), the flow of the pressurising agent is interrupted, except for a small by-pass in an axially parallel by-pass nozzle, which, if required, can be partly or completely closed, in the outer periphery of the supporting ring 27.

Underneath the bottom 23, the control cylinder 20 has a valve seat 35, on which a control unit 36, shaped like a disc sleeve, can come to rest when it is lifted from the valve support 38 of a supporting head 39. In addition, the control unit 36 has, on the circumference of its disc part, a number of recesses 76 which permit a flow connection from top to bottom outside the valve seat 35 when the control unit 36 is raised from the valve support 38.

The control cylinder 20 projects, by means of a tube extension 37, into the supporting head 39, the upper part of which is cylindrical in shape and, at one point on its circumference (in FIG. 1*a*, right), has a branch passage 40. The supporting head 39 is made in one piece with an inside tube 41, preferably of polygonal section, which has, parallel to a back-pressure bore 42, has a flush bore 43 which is connected to the inside of the control tube 32. In the upper part of the supporting head 39 and parallel to the inside tube 41, an intake 44 for the pressurising agent is fitted, the top of which opens into a ring chamber 36*a* connected to the control body 36. Whereas the flush bore 43 is provided with a radial outlet 46, the back-pressure bore, which is closed at its bottom end by a threaded plug 47, has a radial outlet 45 at that point.

Figure 1B:
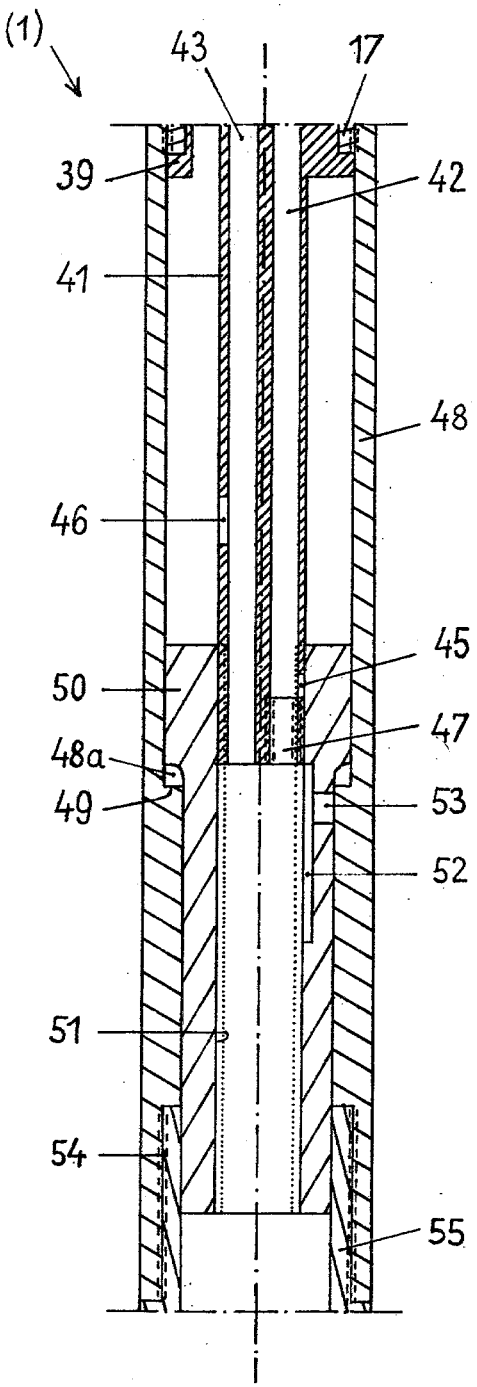

The head portion of a ram 50 moves between the inside tube 41 and the outside wall 48 of the tube 2, this ram having a through hole 51 of polygonal section. A padding space 48*a*, with a shoulder 49 in the outer wall 48, limits the travel of the ram 50, which is shown in FIG. 1*b* in its lowest position. The ram 50 has, at at least one point on its periphery, a recess 52, formed, for example, as a longitudinal slot or groove, to the upper part of which a passage 53 is radially connected.

Connected via a threaded joint 54 to the outer tube 48 is a tube-shaped retainer 55, which, in its inner and outer diameter, continues the tube section located above it, without variation. A shoulder 56, which acts as an anvil stop, and limits the downward travel of the drill steel 4, is fitted in the lower part of the retainer 55.

Connected to the head 57 of the drill steel 4 is its shaft 58 which, like the interior lower part of the retainer 55, has a polygonal section and is provided at its bottom end with an annular groove 59. A fastening ring 63, preferably divided, engages therein and is secured in the bore crown 61, which is in the form of a wear bit 6, between an insert ring 62 and a threaded ring 64 provided with gripping recesses for a tool. The insert ring 62, also, has a corresponding internal polygonal section, as may be seen especially from FIG. 2. On its outer circumference, the fastening ring 62 is radially stepped like a ratchet wheel. The radial projections thus formed in the insert ring 62 engage in corresponding noses 71 in the bore crown 61 via resilient packing 70 which can consist of, for example, wedges of polyurethane. To obtain a damped axial cushioning of the drill steel 4, its bottom end acts together with a resilient pad 65 which, like the shaft 58 of the drill steel, has a central passage 60 and is encompassed on its outer periphery by a stop disc 66 which restricts the downward axial movement of the shaft 58 of the drill steel in the bore crown 61.

The bore crown 61 is fitted with flushing ports 67 which link up with the central passage 60 and terminate in depressions which are connected with chipway grooves 68 indicated by dotted lines in FIG. 10. At the bottom and at the chamfered bottom edge, the bore crown has rigidly fixed hard metal inserts in the form of buttons 69, which are distributed, preferably at regular intervals, around the circumference and the bottom surface.

The mode of operation of such a deep drill hammer is as follows. The pressurising agent reaches the bottom of the borehole through the hole 8 in the damping piston 7 and through the nozzle 34 in the inner tube 32 of the control cylinder 20 via the hole 43, the through hole 51 and the central passage 60, as well as the ports 67, with the result that drillings produced in the process of drilling are continuously flushed out under pressure. When the damping piston 7, the polygonal section of which is indicated in the tube 2, together with its radial outlets 10, reaches the recess 17*b* in the vicinity of the lower position shown (FIG. 1*a*), the pressurising agent passes into the ring chamber 31 of the control cylinder 20 located between the outer section 21 and the control sleeve 28, flows through the holes 24 and the inside of the valve body 36, leaves the latter via the ring chamber 36*a* and passes through the intake 44 into the working space above the ram 50. As a result, the latter moves downwards until the head of the ram 50 has built up an equivalent counter-pressure in the padding space 48*a* in front of the shoulder 49. Previously, the bottom end of the ram 50 strikes the drill steel head 57 which, in consequence, moves downwards in the retainer 55 and forces the wear bit 6 and the bore crown 61 downwards. Because the shaft 58 of the drill steel also passes through the retainer 55 on the one hand, and through the rings 62, 64 on the other hand, with a polygonal section (shown as a dotted line), all axial movements are accompanied by a rotating following movement whenever a rotating movement is transmitted to the drill hammer 1 by a drilling motor (not shown) via a rod (also not shown).

As a result of the impact of the wear bit 6 or of the bore crown 61 on the bottom of the borehole, the drill steel 4 springs back in an upward direction. Its upward movement can be transmitted to the ram 50, which, as a result of this blow and/or because of the back pressure of the pressurising agent in the padding space 48*a*, at first rises far enough for the ports 45 and 52, 53 to communicate with one another. However, the back pressure of the pressurising agent and the upward movement of the ram 50 also cause the valve body 36 to be lifted off the support face 30 and pressed against the valve seat 35. At the same time, the flow of the pressurising agent towards the intake 44 and thus to the upper side of the ram 50 is interrupted. In consequence, the full pressure of the pressurising agent flowing via the peripheral notches 76 past the valve body 36 through the branch passage 40 and the back pressure bore 42 now acts on the underside of the ram 50, causing it to move further upwards and to return to its initial position. The next working cycle can then commence.

Instead of operating at full load in this way, part-load operation is also possible, for example, if the drill steel 4, under the weight of the drill hammer 1 itself, is subjected to a more rapid thrust than that set in the drilling equipment and does not encounter any great resistance in the rock. In this case, the damping piston 7 is retracted upwards as far as the stop 14, and the spring loading on the control sleeve 28 raises the latter until its supporting ring 27 has entered the ring chamber 31 and/or until the flange 30 comes to rest on the inside diameter step of the upper portion 17*a*, closing it off. In the former case, the pressurising agent present in the passage 8 can continue to flow out through the radial outlets 10 and the recess 17*b*; however, it then flows via the cross holes 33 and 28 which, in this position, are aligned with one another, into the inside tube 32 and on into the flush bore 43, with the result that, the nozzle 34 being almost closed, the full operating pressure is exerted therein and the whole of the force of the pressurising agent is available for flushing. Such an increased supply of the pressurising agent is desirable, for example, if the introduction of some 6 $m^3$/min at a pressure of 13 bars is not sufficient for hard rock and the power has to be increased to ensure that adequate quantities of the pressurising agent are always available for flushing the drillings.

Also when the damping piston 7 is raised and flushing is in full swing, the pressurising agent required for idling of the ram 50 is led off through the by-pass nozzle 22 on the supporting ring 27 and flows through the holes 24, the inner part of the valve body 36 and the ring chamber 36*a* into the intake 44, with the result that the upper side of the ram 50 is acted on. Its subsequent upward movement takes place as described above, assisted by the pressurising agent, via the route 78, 40, 42, 45, 52, 53.

The mode of operation of the drill hammer 1 can be very easily adapted to any particular circumstances. For example, nozzles 34 of various orifices can be fitted, by which means the extent of the reduction in pressure and the adiabatic expansion can be adjusted as required. The by-pass nozzle 22 can also be interchanged and, if necessary, shut off.

To enhance the operational reliability, and, in particular, the service life, it can also be advisable to insert damping rings in the padding space 48*a* and/or to the anvil head 50/57, these rings softly cushioning the movement of the corresponding pistons even in those cases where, when operating in the most difficult conditions, wear may have occurred which results in impaired sealing of the axially moving parts.

FIGS. 3 to 5 show a development, and in some respects simplified version of a drill hammer in accordance with the invention, details which, by and large, correspond to the version illustrated in FIGS. 1 and 2 being omitted for the sake of clarity.

It will be seen from FIGS. 3 and 4 that the fitting 3 can be cylindrical in shape, as with the securing of tubular rods, so that the outer diameter corresponds to that of the drill hammer 1. At the top of the fitting 3, on the inside, there is a cone thread 90, which widens out in an upward direction and to which the passage 8 is connected. On the outside, the fitting 3 has a fluted profile 91, the flutes of which are preferably located at regular intervals around the circumference and which can be deeper or more sharply profiled than is shown in FIG. 3. This fluted profile 91 can be used in conjunction with gripping and breaking equipment with a form-locking mating profile which grasps the fitting 3 in the manner of jaws or cheeks when it is required to assemble or undo the screw connection with a tubular rod (not shown). The fitting 3 also has a circumferential annular groove 92, in which the clamps, cheeks or segments of a suitable holding device can engage in order to bear the drill hammer 1 or to support its own weight.

In a manner similar to the example shown in FIG. 1*a*, the fitting 3 can also, in the version depicted in FIG. 4, be transposed into a damping piston, the guideway of which is either integral with, or rigidly joined to the outside tube of the drill hammer. In an exceptionally simplified form, however, the control assembly which, in the example described above, is comprised of the elements 20 to 47, can in this case be dispsned with.

Radial openings 94 are provided near the lower end, closed at its front face, of the inside tube 93, which is fixed, in relation to the outside tube, in a way which is not illustrated, but which can, in certain circumstances, even be connected with the damping piston or be in one piece. The inner tube 93 carries the ram 95, for which purpose there can, for example, be a disharmonic polygonal section (resembling Type PC4). The ram 95 has a number of axial passages 96 which are staggered in a peripheral direction in terms of a corresponding number of radial outlets 97. In the lowest position of the ram 95, shown in the drawing, these open out into a ring-shaped padding space 78, the bottom of which is bounded by a shoulder 99 in the outside tube 98. This shoulder 99 merges into a retainer 100, the shoulder 56 of which limits a corresponding padding space 77 for the head 57 of the drill steel 4. Like the retainer 100, the shaft 5 or 58 of the drill steel is of polygonal section, and a passage 60 runs through its centre.

As may be seen from FIG. 5, four axial passages 96 and four radial outlets 97 are staggered in relationship to one another at regular peripheral intervals, in the version illustrated. It should be noted that, in accordance with the invention, it is possible to have other forms of cross-section for the passages, other distributions of them and different numbers of the corresponding channels.

The ram 95, when acted on by the pressurising agent, in practice effects its own control through the pressure of the drill steel 4. To start with, it is forced downwards by the pressure of the pressurising agent flowing into the working space outside the inside tube 93. Towards the end of its stroke, a flow connection is established between the radial openings 94 in the inside tube 93, the radial outlets 97 in the ram 95 and the padding space 78, with the result that a counter-pressure builds up therein which prepares for and assists the reversal of movement of the ram 95. Before that, however, the underside of the ram 95 strikes the head 57 of the drill steel 4, which is consequently forced downwards and, in turn, is cushioned by gas in the padding space 97 (sic). When the ram 95 is moved upwards by the pressure of the bore crown 6 or 61 and/or by the counter-pressure built up in the padding space 78, there is a temporary interruption of the downward flow of the pressurising agent through the axial passages 96 until the radial openings 94 in the inside tube 93 are uncovered by the passing ram 95. While the flushing process is immediately resumed, the hermetic shutting off of the lower apertures of the axial passages 96 has the effect that, in the meantime, the full working pressure is exerted on the ram 95, leading to the start of a new operating cycle.

It should be mentioned that there can be a polygonal section (not shown, in the interests of clarity) to guide the ram 95 in the inside tube 93 but, in exactly the same way as with the example depicted in FIGS. 1 and 2, it is also possible, and provision is made for this in the invention for the guide of the ram 95 to make use of cylindrical parts, if the appropriate ducts, peripheral recesses, etc., are present to permit a suitable system of control.

The invention invariably prescribes a polygonal section for the sliding connection between the tube 2 and the fitting 3 and the drill steel 4. Resilient packing can be provided as required for the padding spaces or the corresponding shoulders of the axially moveable parts, in the form of rings which are held axially in corresponding annular grooves. Similar packing can, if necessary, also be placed between the retainer 55 or 100 and the bore crown 61 or the wear bit 6; for example, the threaded ring 64, which should preferably bear, by means of a stop collar, on the upper edge of the wear bit, can have or form a resilient packing.

The deep drill hammer in accordance with the example shown in FIGS. 6 to 10 corresponds, in its basic design, to the version described above. Identical or similar parts are therefore indicated by the same reference numbers. There are, however, the following differences.

The ring buffer 16 has a somewhat smaller diameter than the adjacent cage 17. Two annular grooves 79 are for the purpose of improving the volume equalisation when the ring buffer 16, compressed by the descending damping piston 7, comes up against the inside wall of the tube 2.

In the upper part 17*a* of the cage 17, which has a cylindrical re-entrant, the ring-shaped recess 17*b* permits the pressurising agent to flow out of the radial outlets 10 in any position of the damping piston 7.

The outer section 21 of the control cylinder 20, on which a compression spring 19 in the case 17 bears, has, at the top, a cylinder projection 21*a*, narrowing inwards, the inside diameter of which corresponds to the outer diameter of the supporting ring 27 of a control sleeve 28, which is fitted, so that it can slide, on the upper section of a control tube 32. The latter has, on its front face, an intercgangeable nozzle 34 and, in the vicinity thereof, is provided with long cross holes 33 which, when the control sleeve 28 is in the raised position, can be aligned with the cross holes 29 in the latter.

Holes 24 are provided in the bottom of the control cylinder 20, and also a ring-shaped recess 25 to take a compression spring 26, the upper end of which is attached to the supporting ring 27. As a result, the control sleeve 26 is held with its flange 30 against the lower end of the tube extension 9, even when the damping piston 7 travels upwards from its bottom end position. The control sleeve 28, which moves upwards with it, enters with the supporting ring 27 into a ring chamber 31 inside the narrowed cylinder projection 21*a;* FIG. 6*a* illustrates the start of this phase. In this position, the flow of the pressurising agent is restricted to small bypass passages, viz., longitudinal ducts in the form of flutes on the outer circumference of the supporting ring 27.

The bottom 23 of the control cylinder 20 is connected in a form-locking manner to the upper section of a valve seat 35 on the control tube 32, on the upper part of which the control sleeve 28 is fitted so that it can slide along. The lower section of the control tube 32, in the form of a tube extension 37, projects into the supporting head 39, which is made in one piece with the inside tube 41, the outside of which should preferably by cylindrical. FIGS. 9 and 10 show details of the construction, from which it is possible to see the arrangement of the various holes 42, 43 and 44, which engage in one another or are connected together with optimum utilisation of space and materials. It is particularly advantageous if the branch passage 40, which is important for supplying the back pressure bore 42, to be in the form of a flat tapping, to each of the axial ends of which three skewed ports 83, 83*a*, for example, are connected. The back-pressure bore 42, which is closed at its bottom end by a threaded plug 47, has a radial port 45 higher up. The flush bore 43 is provided some distance from its bottom end with a radial port 46, below which an additional starting port 46*a* leads radially outwards.

The ram 50, which runs between the inside tube 41 and the outer wall 48, has a cylindrical through hole 51, in the circumference of which flutes 82 have been made. The ram 50, shown in FIG. 6*b* near to its lowest position, has, at at least one point on its periphery, a relief clearance 52 in the form of a tapping, on the upper part of which two opposite passages 53 are connected obliquely or radially, while at the axially power end of the recess 52, for example, two or four passages 53*a* are located, which can run obliquely or radially.

Beneath the shoulder 49 which forms the extremity of the padding space 48*a*, the outside tube 48 has a ring chamber 85 to the underside of which, for example, six or more ventiducts 84 are connected. These latter run parallel to the outside wall 48 and lead as far as the threaded joint 54 with the upper section of the retainer 55. In conjunction with an annular gap 86 between the outside tube 48 and the upper part of the retainer 55, these hollow spaces 84, 85 ensure that the ram 50 can always start up, irrespective of the position it may be in, that is to say, even in unfavourable pressure conditions.

The retainer 55 is split radially. Its halves are joined together by pins 89 after the bit head 57, the diameter of which is larger than that of the bit shaft 58, has been inserted in the retainer 55. This continues, on the inner and outer diameter, the section of tube lying above it, without change.

Like the inside lower section of the retainer 55, the shaft 58 of the drill steel 4 is of polygonal section. It is fitted at its lower end with a form of shoulder 73, and is connected, in a form-locking manner, either direct or by means of a resilient pad (not shown) of flexible, yielding material, to the inside bearing face 74 of the bore crown 61 forming the wear bit 6.

For its connection with the bottom end of the bit shaft 58, the bore crown 61 has a radially divided fastening ring 63 with a thread 64, which turns in the same direction as the hammer drive and preferably has symmetrical rounded flanks shaped like a corrugated tube. At its upper stop collar 72, the fastening ring 63 is of polygonal section inside, which grips the bit shaft 58 in a form-locking manner (FIG. 7). The bore crown 61 has a widened foot 75 and, as in the example previously described, is provided with a number of passages 60 and 67 for the flushing air and with hard metal inserts in the form of buttons 69 uniformly distributed, by preference, around the circumference and on the bottom surface.

The mode of operation of such a deep drill hammer corresponds very closely to that of the examples shown in FIGS. 1 to 5. When the damping piston 7, the polygonal section of which in the tube 2 is shown as a dotted line, together with its radial outlets 10, reaches the recess 17*b* near to the lower position shown (FIG. 6*a*), the pressurising agent passes into the ring chamber 31 of the control cylinder 20 located between the outer section 21 and the control sleeve 28, flows through the holes 24 and the inside of the valve body 36, leaves the latter via the ring chamber 36*a* and passes through the intake 44 into the working space above the ram 50. As a result, the latter moves downwards until the head of the ram 50 has built up an equivalent counter-pressure in the padding space 48*a* in front of the shoulder 49. Previously, the bottom end of the ram 50 strikes the bit head 57, which as a result is moving downwards in the retainer 55, so that the drill steel 4, together with the wear bit 6 or bore crown 61, moves downwards. Thanks to the polygonal section of the power-transmitting parts, all axial movements are accompanied by a rotating following movement when a rotating movement is transmitted to the drill hammer 1 by a drilling motor (not shown) via a rod (also not shown).

After striking the bottom of the borehole, the drill steel 4 springs back in an upward direction, and in so doing, the downward (sic) movement can be transmitted to the ram 50 which, as a result of this blow and/or because of the back pressure of the pressurising agent in the padding space 48*a* and in the hollow spaces 86, 84, 85, at first rises far enough for the ports 47 and 53 to communicate with one another and with the padding space 48*a*. At the same time, the valve body 36 is raised from the support face 38 and pressed against the valve seat 35, so that the flow of the pressurising agent towards the intake 44 and thus to the upper side of the ram 50 is interrupted. The full pressure of the pressurising agent flowing via the peripheral notches 76 past the valve body 36 through the branch passage and the back pressure bore 42 now acts on the underside of the ram 50, causing the latter to return to its original position. With this full load operation, the next working cycle can now commence.

In the case of part-load operation, the damping piston 7 rests on the stop 14 and the spring loading on the control sleeve 28 raises the latter until its supporting ring 27 has entered the ring chamber 31. In this position, the radial outlets 10 are wholly or partly shut off at the collar of the cage 17, which is sealed by an O-ring 80. Only in this latter case can the pressurising agent present in the passage 8 flow out through the radial outlets 10 and the recess 17*b;* it then flows through the cross holes 33 and 29 which, in this position, are aligned with one another and on into the flush bore 43, with the result that, the nozzle 34 being almost closed, the full operating pressure is exerted therein and the force of the pressurising agent is to a large extent available for flushing. However, a certain amount of the pressurising agent for idling of the ram 50 is led off through the flutes 27*a* on the supporting ring 27 and flows through the holes 24, the inner part of the valve body 36 and the ring chamber 36*a* into the intake 44, with the result that the upper side of the ram 50 is acted on. Its subsequent upward movement proceeds as described above, assisted by the pressurising agent, via the route 76, 40, 42, 45, 52, 53 or 53*a*, 85, 86.

The arrangement of the relief cavities 52, 53, 53*a* in the ram 50 and of the chambers 84 to 86 in the outside tube 48 is of great importance to the operation of the drill hammer. They permit certain starting of the ram 50 from any initial position, even in extremely unfavourable conditions. Because further lower relief passages exist in the form of the clearance of the drill steel 4 and of longitudinal flutes in the retainer 55, ventilation is assured in all operating phases of the drill hammer.

In this connection, the very simple control is of great importance. The control cylinder 20 is placed on the upper part of the control tube 32, on its valve seat collar 88, and is held against it by the compression spring 19. The control piston 28, under load from the pressurising agent on the one hand, and from the compression spring 26 on the other hand, slides to and fro along the control tube 32, and its cross holes 29, located near the supporting ring 27, come into flow connection, in the upper position, with the longitudinal holes 33 near the upper end of the control tube 32. The longitudinal flutes 27*a* on the outer circumference of the supporting ring 27 form additional openings which make possible the functions described above.

Sealing rings are provided at various points on the drill hammer, e.g., the slide insert 12, the O-ring 80 on the tube extension 9 of the damping piston 7, the O-ring 81 between the top section 39 of the inside tube and the cage 17, etc. In addition, for the further increase in the operating reliability, and especially of the service life, damping rings can be inserted in one or more of the padding spaces 15, 48*a* and 77, which always cushion the movement of the corresponding piston.

The sectional view in FIG. 7 shows on the one hand the PC4 section of the retainer 55, with flutes 87 machined therein to take the bit shaft 58. An outer fluted profile 91 can be used in conjunction with gripping and breaking equipment (not shown) for assembling and dismantling the drill hammer. Preferably, therefore, all the outer parts of the drill hammer 1 should have this fluted profile 91, as may, for example, also be seen from FIG. 8, which shows a section through the lower part of the outside tube 48 and the ram 50.

Many more variations and simplifications are to be found within the general concept of the invention. All the features and advantages of the invention originating in the claims, the description and the drawing, including details of design, spatial layout and operating procedures can be of importance, in terms of the invention, both on their own and in the widest variety of combinations.

I claim:

1. A down hole percussion drill assembly adapted for connection to a drill string comprising in combination (a) an outer tube, (b) an inner tube located within said outer tube, (c) a ram positioned between the cylindrical inner wall of said outer tube and the exterior surface of said inner tube, said ram containing a through-hole and being mounted for longitudinal reciprocating movement, (d) a steel drill member comprising an upper end, a lower end with a bit, and an intermediate shaft portion, (e) retainer means for connecting the upper end of said steel drill member to the lower end of said outer tube, said inner tube having air openings in the form of two separate axially parallel longitudinal conduits having their axes arranged on a common main diameter of said inner tube and having lower openings, the upper portion of said inner tube being rigidly connected to a unitary supporting head into which a coaxial control cylinder projects, the said control cylinder having a valve seat for a mushroom valve that is provided at its outer edge with peripheral notches and is slidingly movable inside said supporting head which is firmly secured in a tube-shaped cage screwed to said outer wall, said control cylinder being adapted to move in said cage.

2. The drill assembly according to claim 1, wherein said control cylinder has an inner control tube with cross holes at the top, to which control tube a spring-loaded control sleeve is slidably fitted, and wherein said control cylinder further has, at its bottom, corresponding cross holes.

3. The drill assembly according to claim 2, wherein said control sleeve has a supporting ring, by means of which a ring chamber of said control cylinder is sealed off in the upper position.

4. The drill assembly according to claim 1, wherein said supporting head has a lateral intake ending beside the inner tube, one hole of said lateral intake being connected to said inner control tube while the other hole in said supporting head intake has a branch passage underneath said control cylinder.

5. The drill assembly according to claim 2, wherein an interchangeable nozzle is fitted in an upper closure in the front face of said control tube.

6. The drill assembly according to claim 1, wherein an interchangeable by-pass nozzle is arranged in the outer region of said control cylinder.

7. The drill assembly according to claim 1, having hollow spaces for starting-up ventilation in said ram and in said outer tube surrounding it, wherein obliquely running holes are provided in said ram, said ram holes being located at the axial ends of a cylindrical recess in said ram and running obliquely upwards and ending radially in a padding space between the head of said piston and said outer tube such that said ram holes open into an annular space in said outer tube when said ram is in its raised position, wherein ventilation ducts run from said annular space through the wall of said outer tube to a threaded joint on said first retainer means for said steel drill member and wherein a radial starting-up hole is provided in the bottom part of one of said longitudinal conduits in said inner tube, on the outside beneath a radial opening.

8. The drill assembly according to claim 3, wherein said control cylinder has elongated cross holes near its upper end and is adapted to be positively locked to a collar of a valve seat on the upper part of said control tube, and wherein said control sleeve has longitudinal flutes on the outside of its supporting ring.

9. A down hole percussion drill assembly adapted for connection to a drill string comprising in combination:

(a) an outer tube, (b) an inner tube located within said outer tube, (c) a ram positioned between the cylindrical inner wall of said outer tube and the exterior surface of said inner tube, said ram containing a through-hole and being mounted for longitudinal reciprocating movement, (d) a steel drill member comprising an upper end, a lower end with a bit, and an intermediate shaft portion, (e) retainer means for connecting the upper end of said steel drill member to the lower end of said outer tube, said retainer means, steel drill member and bit being provided with matching disharmonic polygonal profiles, the edges of which are rounded at the curvature of an outer radius, the areas therebetween being curved surfaces of flat cycloid section such that the curvature changes at the corners.

the bottom end of said steel drill shaft positively engaging in the inner front face of said bit and wherein said bit is adapted for sliding movement relative to said steel drill shaft and is provided with flexible cushion means, said bit being provided with polygonal insert means, the outer part of which is recessed on its circumference and by means of resilent packing is cushioned in a peripheral direction.

* * * * *